United States Patent [19]

Watatani

[11] 4,389,943

[45] Jun. 28, 1983

[54] TRANSFER TRUCK

[75] Inventor: Minoru Watatani, Chiba, Japan

[73] Assignee: S. I. Handling Systems, Inc., Easton, Pa.

[21] Appl. No.: 213,422

[22] Filed: Dec. 5, 1980

[30] Foreign Application Priority Data

Dec. 12, 1979 [JP] Japan ..... 54-172716[U]

[51] Int. Cl.[3] ..... B61B 13/12

[52] U.S. Cl. ..... 104/166; 105/170; 105/182 R

[58] Field of Search ..... 104/140, 165–167; 198/725; 74/89; 105/167, 170, 182 R

[56] References Cited

U.S. PATENT DOCUMENTS 402,933 5/1889 Judson ..... 104/166
423,871 3/1890 Judson ..... 104/166
2,826,319 3/1958 Renner et al. ..... 104/165 X

FOREIGN PATENT DOCUMENTS 2293345 7/1976 France ..... 104/166
738694 10/1955 United Kingdom ..... 104/167

*Primary Examiner*—Randolph Reese
*Attorney, Agent, or Firm*—Seidel, Gonda, Goldhammer & Panitch

[57] ABSTRACT

A driverless transfer truck includes a chassis having two bogies for riding on rails. Each bogie is provided with at least one drive wheel which is pressed against a drive shaft so that the force for propelling the truck is produced by the friction engagement between the drive wheel and the drive shaft. By attaching the drive wheels to the bogies, the truck can negotiate a curved section of the rails having a smaller radius than is otherwise possible.

3 Claims, 8 Drawing Figures

TRANSFER TRUCK

BACKGROUND

A typical prior art driverless vehicle for use on rails having a straight section and a curved section is set forth hereinafter in connection with FIGS. 1 and 2 of the attached drawings. When the vehicle traverses the curved section of the tracks, the propelling force is jerky unless the radius of curvature for the rails is quite large.

The present invention is a solution to this problem whereby the radius of curvature may be smaller than that used heretofore while at the same time providing for a smoother propelling force.

SUMMARY OF THE INVENTION

A transfer truck is characterized by two bogies for riding on rails and pivotably mounted on a chassis. Each bogie is provided with at least one drive wheel which in turn is adapted to be pressed against a drive shaft so that the force for propelling the truck is produced by the friction engagement of said drive wheel with said drive shaft. The drive shaft is rotatable about its axis and is disposed in parallel between the rails.

It is an object of the present invention to provide a driverless truck which may negotiate sharper turns at a curved section of the rails with a uniform speed.

Other objects will appear hereinafter.

For the purpose of illustrating the invention, there is shown in the drawings a form which is presently preferred; it being understood, however, that this invention is not limited to the precise arrangements and instrumentalities shown.

DETAILED EXPLANATION-PRIOR ART

Figure 1:
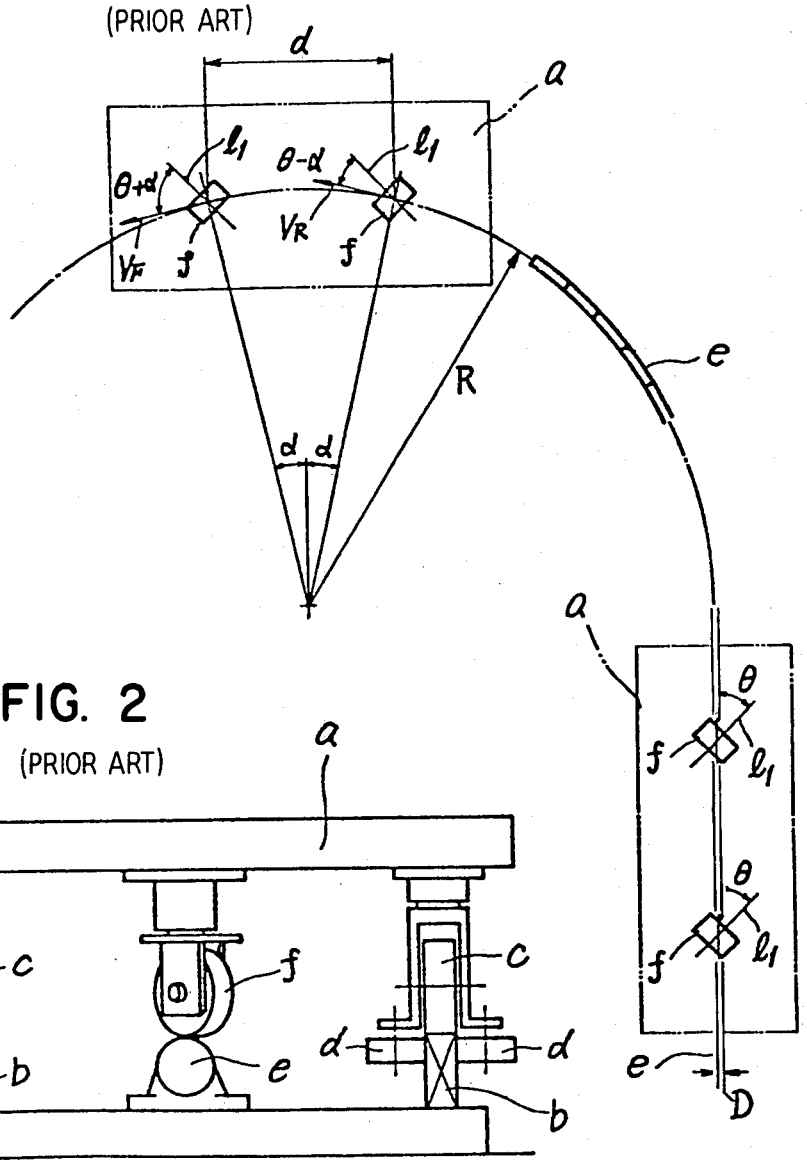
FIG. 1 (PRIOR ART)
FIG. 1 is a plan view of a prior art transfer truck and rail system.
Figure 2:
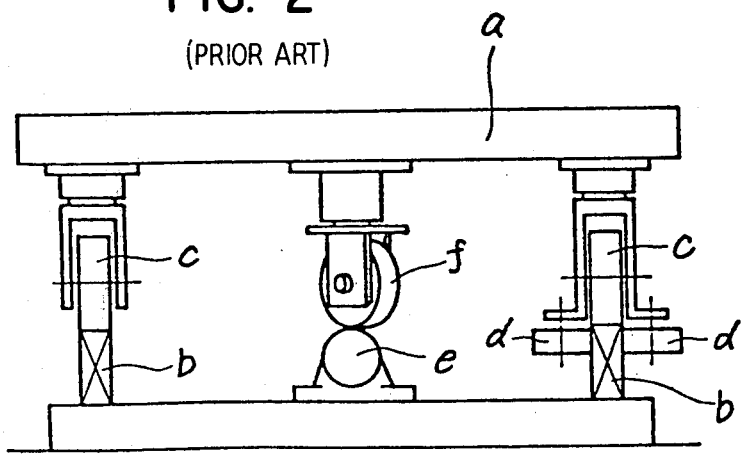
FIG. 2 (PRIOR ART)
FIG. 2 is a front view of a prior art transfer truck shown in FIG. 1.

The prior art as exemplified by FIGS. 1 and 2 includes a driverless truck (a) having support wheels (c) which ride on rails (b). One side of the truck (a) is provided with guide wheels (d) which in turn cooperate with one of the rails (b).

A series of aligned drive shafts (e) are disposed in parallel between the rails (b). Drive shafts (e) having a diameter (D) rotate about their axes. A pair of drive wheels (f) on the truck (a) are pressed against the drive shafts (e) so that the force for propelling the truck is produced by the friction engagement with the drive shafts. The angle between the axis of shafts (e) and the axis of rotation ($l_1$) of drive wheels (f) is $\theta$. When angle $\theta$ is zero the truck is stationary.

At a curved section of the rails having a radius (R), the rear drive wheel (f) produces a speed vector ($V_R$).

The front wheel (f) produces a speed vector ($V_F$). The angle between the vector ($V_R$) and the axis of rotation of rear wheel (f) is $\theta-\alpha$. The angle between vector ($V_F$) and the axis of rotation of front wheel (f) is $\theta+\alpha$. The symbol $\alpha$ is one-half the included angle from the radius point to the drive wheels (f) as they negotiate the curved section of the rails. The force of the drive wheels as indicated by the speed vectors ($V_R$ and $V_F$) is different and the direction of the vectors is different whereby the propelling force along the curved section is non-uniform or jerky unless the radius (R) is quite large.

The present invention is a solution to that problem whereby the speed of the truck as it negotiates a curved section of the rails will be uniform while at the same time the radius of the curved section may be smaller than that capable of being attained heretofore.

DETAILED DESCRIPTION OF THE INVENTION

Figure 3:
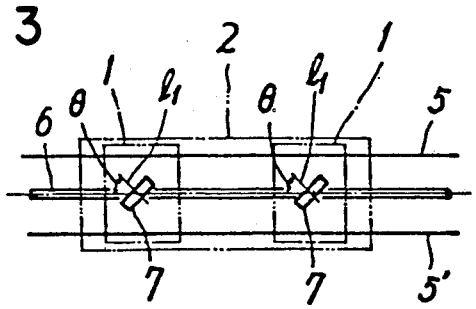
FIG. 3 is a plan view of a truck in accordance with the present invention.
Figure 4:
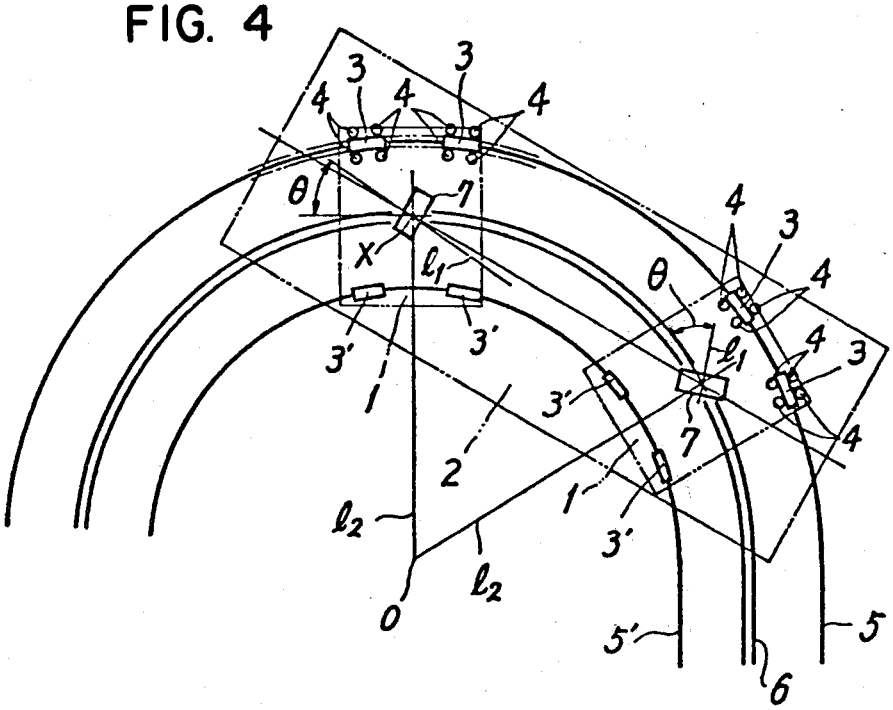
FIG. 4 is a plan view of the truck shown in FIG. 3 while negotiating a curve section of rails.
Figure 5:
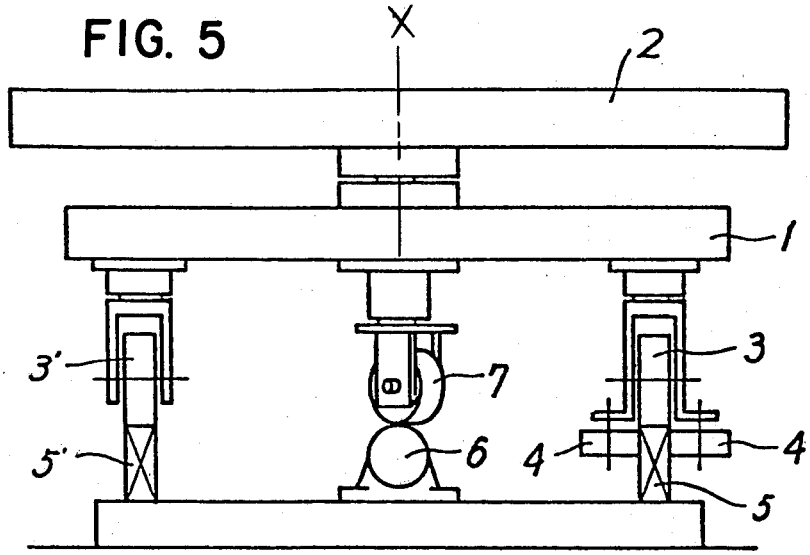
FIG. 5 is a front view of the transfer truck of the present invention.

A first embodiment of the driverless transfer truck of the present invention is shown in FIGS. 3–5. In FIG. 3, the transfer truck is shown along a straight portion of rails 5, 5'. The driverless chassis 2 is provided with a pair of bogies designated 1 which are pivotably mounted to the bottom of the chassis 2. Each bogie 1 has a drive wheel 7 pressed against a drive shaft 6 which rotates about its longitudinal axis. The vertical axis of rotation of drive wheels 7 corresponds with the pivotable axis of the bogies and is designated X. The drive wheels 7 pivot between a maximum speed position and a stationary or minimum speed position. When the drive wheels 7 are in their maximum speed position, they rotate about a horizontal axis designated $l_1$. Angle $\theta$ in FIG. 3 is the same as angle $\theta$ in FIG. 1 with respect to the straight section of the track shown therein.

In accordance with the present invention, angle $\theta$ remains constant even though the truck is negotiating a curved section of the rails as shown more clearly in FIG. 4 wherein the center of curvature is O and the radius is $l_2$. The bogies 1 have a pair of support wheels 3 on one side for contact with rail 5 and a pair of support wheels 3' on the other side for contact with rail 5'. Each of the support wheels 3 is provided with four guide wheels 4 which are in contact with the rail 5.

The radius $l_2$ in FIG. 4 is less than the radius (R) in FIG. 1. Since each of the bogies 1 is independently swivelled with respect to the chassis 2, angle $\theta$ remains constant and the direction of the speed vectors is longitudinally of the respective bogies. Since the speed vectors do not fight one another, the propelling force is uniform. Since each bogie may independently swivel about X with respect to the chassis 2, the radius for the curved section of the rails may be smaller than that utilized heretofore.

Figure 6:
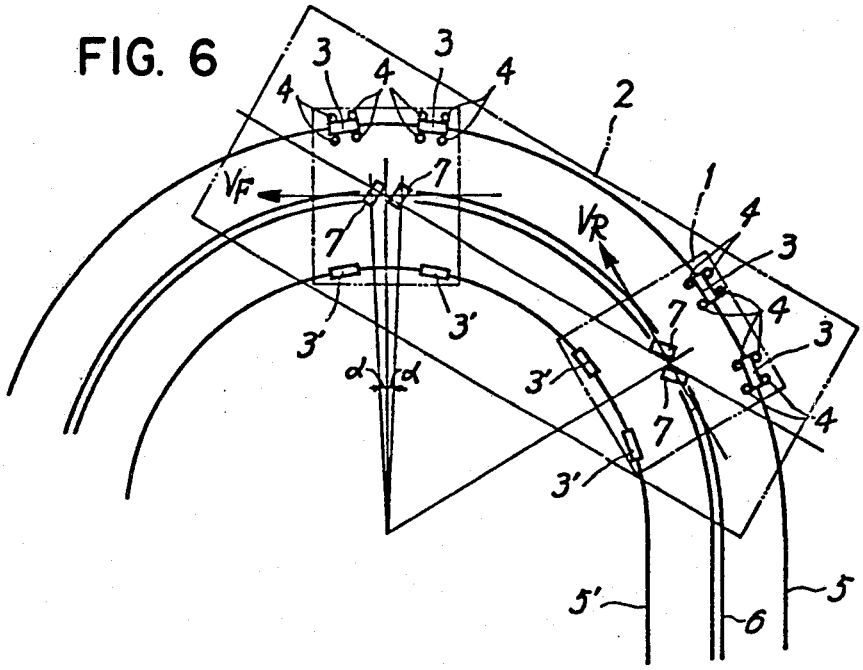
FIG. 6 is a plan view similar to FIG. 4 but showing another embodiment.
Figure 7:
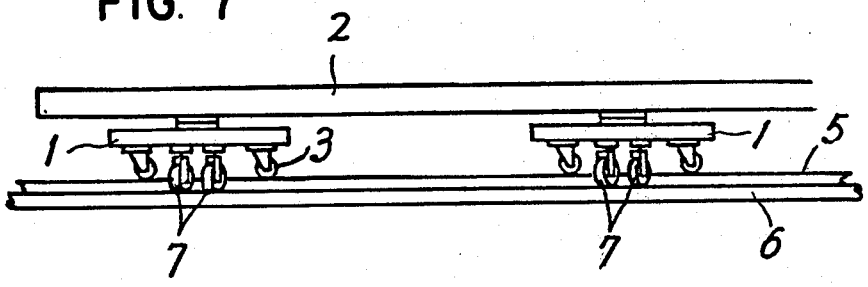
FIG. 7 is a side view of another embodiment of the transfer truck shown in FIG. 6.
Figure 8:
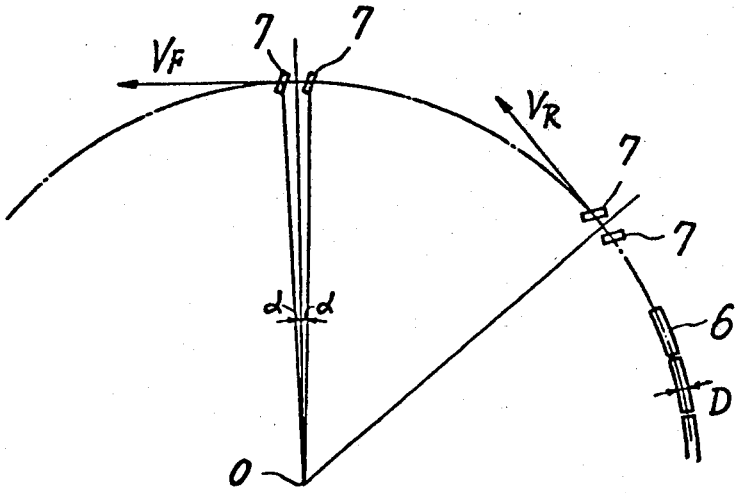
FIG. 8 is a diagram for explaining velocity of the embodiment shown in FIGS. 6 and 7.

In FIGS. 6–8, there is illustrated a second embodiment of the present invention which is the same as that disclosed in FIGS. 3–5 except as will be made clear hereinafter. In FIGS. 6–8, each of the bogies 1 has a pair of interconnected drive wheels 7 whereby larger propelling forces are provided so that the chassis 2 may support a heavier load. The drive wheels 7 of each pair are close to one another whereby angle $2\alpha$ is quite small such as 3°–5°. FIG. 8 is a simplified diagram of FIG. 6. As shown in FIGS. 6 and 8, the speed vector $V_F$ of the front drive wheels is longitudinally of the front bogie and the speed vector $V_R$ of the rear drive wheels is longitudinally of the rear bogie.

The present invention may be embodied in other specific forms without departing from the spirit or essential attributes thereof and, accordingly, reference should be made to the appended claims, rather than to the foregoing specification, as indicating the scope of the invention.

I claim:

1. A driverless transfer truck for negotiating a curved track at uniform speed comprising a chassis having two bogies, each bogie having support wheels for riding on rails, each bogie being pivotably mounted to a bottom of said chassis, each bogie being provided with at least one drive wheel which is adapted to be pressed against a drive shaft so that the force for propelling the truck is produced by the friction engagement between the drive wheel and the drive shaft, said support wheels and said drive wheel on each bogie being at substantially the same elevation.

2. A truck in accordance with claim 1 wherein each bogie is pivoted to the chassis for movement about a vertical axis, each drive wheel being pivoted about the vertical pivot axis of its bogie for movement between a maximum speed position and a stationary or minimum speed position, and the speed vector of each drive wheel being longitudinally of its bogie.

3. A driverless transfer truck system comprising rails, a chassis having support wheels for riding said rails, a drive shaft rotatable about its axis disposed parallel to and between said rails, at least two drive wheels supported by the truck chassis for engagement with said drive shaft at the 12 o'clock position thereon so that a propelling force is produced by friction engagement with the drive shaft, means for enabling the truck chassis to negotiate turns at a uniform speed, said means including a pair of bogies pivotably mounted to said chassis and located below the chassis, one of said drive wheels being centrally supported by each of said bogies, each bogie supporting two sets of said support wheels, said support wheels and drive wheels being at substantially the same elevation.

* * * * *